United States Patent [19]

Martenson

[11] Patent Number: 4,483,312

[45] Date of Patent: Nov. 20, 1984

[54] FREE STANDING STOVE

[76] Inventor: Donald S. Martenson, 14935 S. Leland Rd., Beavercreek, Oreg. 97004

[21] Appl. No.: 403,484

[22] Filed: Jul. 30, 1982

Related U.S. Application Data

[63] Continuation-in-part of Ser. No. 165,046, Jul. 1, 1980, Pat. No. 4,359,040.

[51] Int. Cl.[3] ..... F24C 1/14

[52] U.S. Cl. ..... 126/77; 126/163 R

[58] Field of Search ..... 126/77, 163 R, 163 A, 126/112, 15 R, 15 A, 67, 146, 242, 245, 290

[56] References Cited

U.S. PATENT DOCUMENTS

| | | | |
|---|---|---|---|
| 621,373 | 3/1899 | Poillon | 126/163 R |
| 844,292 | 2/1907 | Thurston | 126/77 |
| 3,610,179 | 10/1971 | Shaw | 110/214 |
| 4,180,051 | 12/1979 | Maier | 126/77 |
| 4,207,861 | 6/1980 | Buckner | 126/77 |
| 4,232,650 | 11/1980 | Frank | 126/77 |
| 4,248,203 | 2/1981 | Willson | 126/77 |
| 4,313,418 | 2/1982 | Schrader | 126/77 |
| 4,326,495 | 4/1982 | Millar | 126/77 |
| 4,343,288 | 8/1982 | Tjosvold | 126/112 |
| 4,359,040 | 11/1982 | Martenson | 126/163 R |

OTHER PUBLICATIONS

Masters Choice–Defiance Company Brochure, 1980.

*Primary Examiner*—Daniel J. O'Connor

*Attorney, Agent, or Firm*—Klarquist, Sparkman, Campbell, Leigh & Whinston

[57] ABSTRACT

The present invention provides a stove having the following features: a firebox for initiating the combustion of fuel, the firebox including a lower portion with a draft inlet therein; a first conduit disposed under the firebox for conveying combustion air to a draft inlet and for insulating the underside of the firebox; a secondary combustion chamber for receiving hot gases of combustion from the firebox and continuing the combustion; a second conduit which receives air from the first conduit adjacent the draft inlet and which conveys all the air which has not passed through the draft inlet along the periphery of the firebox and into the secondary combustion chamber, thereby increasing the flow of air through the secondary combustion chamber during periods of low combustion and for continuing the insulation of the firebox; and a third conduit for conveying the gases of combustion from the secondary combustion chamber to a flue.

12 Claims, 11 Drawing Figures

FIG. 8
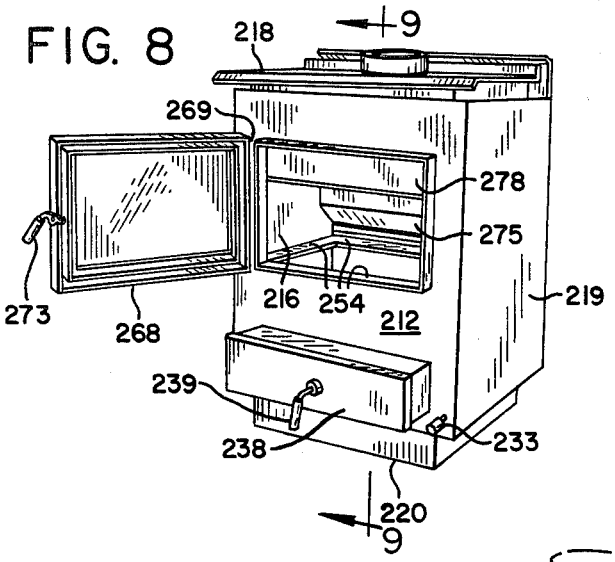
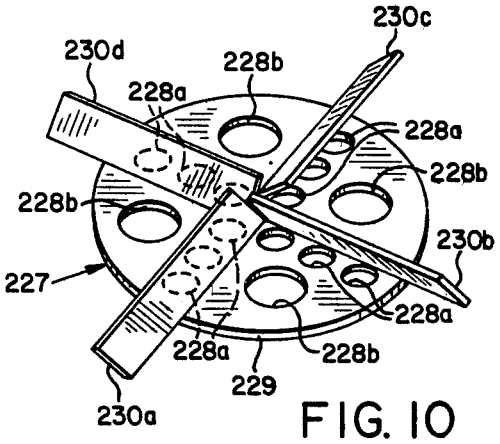
FIG. 10
FIG. 9
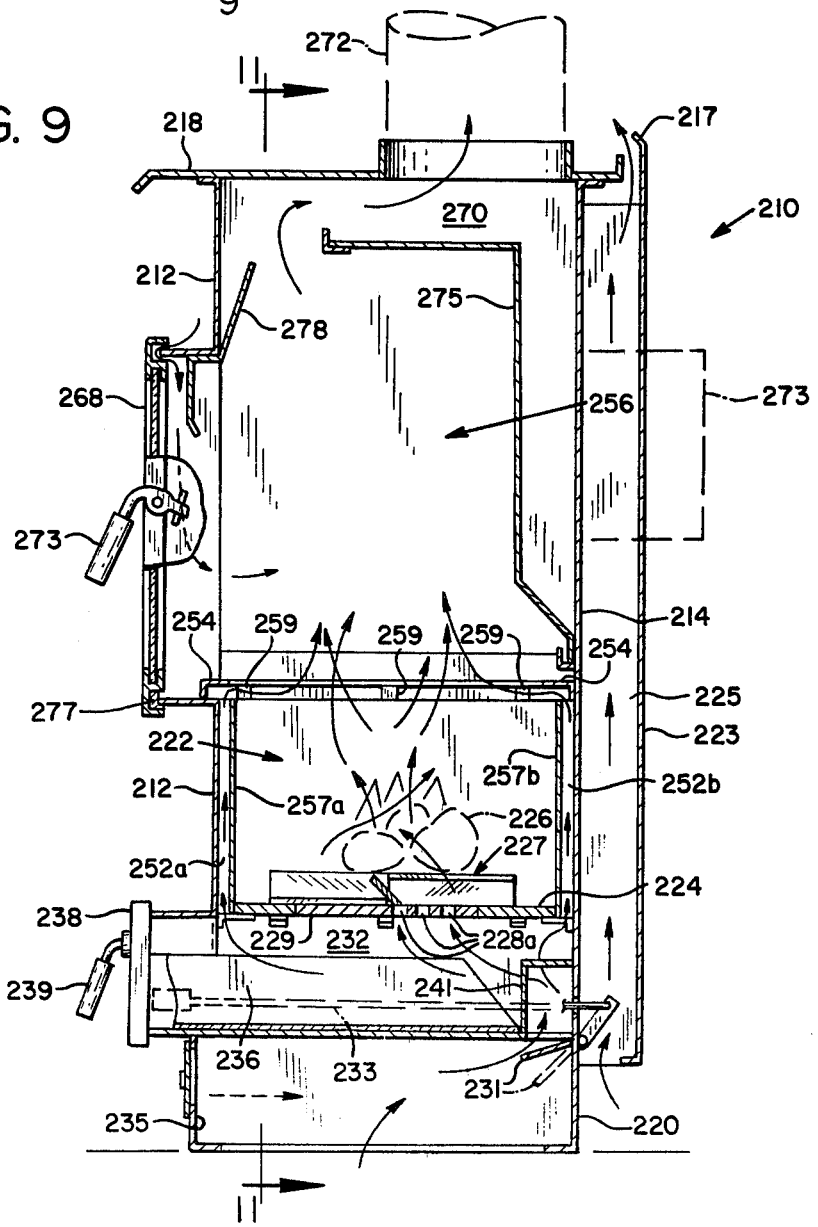

FREE STANDING STOVE

BACKGROUND OF THE INVENTION

This is a continuation-in-part application of my earlier application bearing the same title, filed July 1, 1980, designated Ser. No. 165,046, now U.S. Pat. No. 4,359,040.

Field of the Invention

This invention relates to free standing stoves in which heat from the stove may be used to heat the air in a room and/or to cook food.

Discussion of the Prior Art

Free standing wood and coal burning stoves were used for many years prior to the advent of electricity and the widespread use of fuel oil and natural gas. The term "free standing" as used herein is intended to define the type of stove which is complete in and of itself. For example, it need not necessarily be positioned within or be used in combination with any other type of stove or fireplace. It may be advantageous in some instances, however, to utilize a fireplace flue stack in the event the stove is going to be positioned in the vicinity of a fireplace.

Stoves of this type are intended to burn the fuel as completely as possible and transmit the heat released thereby into the room or dwelling. Early stoves were often constructed of cast iron or other metals which were capable of absorbing and subsequently releasing large amounts of heat. Wood and coal burning stoves have thus historically relied primarily upon radiation of heat from the stove into the immediately surrounding air space. While such stoves were acceptble to the early pioneers who lived in small dwellings and had abundant, free fuel close at hand, shortcomings became apparent as civilization and technology progressed. Specifically, the inefficient design of early stoves resulted in most of the heat passing up out of the stove through the flue stack.

Realization of the inefficiency of the early stoves led to the development of more advanced units which took advantage of natural convection of air and combustion gasses through the stove. An example of this type of stove is disclosed in U.S. Pat. No. 4,127,100 to Baker. This patent describes a stove having the conventional box-like shape, fabricated from iron or steel plate. The stove includes a single combustion chamber or firebox in which wood is placed for burning. Draft inlets are positioned in the front of the firebox while the flue or stack is at the rear. An air duct is located toward the back of the firebox. The lower end of this air duct receives ambient air and directs it upwardly and then across the top of the firebox in a plurality of tubes before discharging the air out the front of the stove. The gases of combustion thus contact these air tubes before they exit out the rear of the firebox. As the hot gases pass out of the combustion chamber they are directed downwardly by a baffle plate which causes the gases to contact the upwardly extending air duct, thus imparting heat to the air as it enters the air duct.

The Baker design is typical of second generation wood burning stoves in that it attempts to utilize the natural convection of air and gases through the stove. While Baker's stove is an improvement over first generation designs, it is lacking in several respects. First, in this stove the greatest amount of combustion chamber heat is applied to the air tubes at the rear of the firebox where the ambient air is relatively cool, rather than toward the front of the firebox where the ambient air has reached its highest temperature. A second disadvantage with this stove is that means are not provided for preheating ambient air which is induced into the firebox. Perhaps this is one reason why the draft inlets are positioned in the front rather than at the bottom of the stove, thereby ensuring that the warm, rather than cool, air will be induced into the stove. However, this removal of warm air from the space to be heated defeats the purpose of even having a stove. Moreover, induction from the front provides for poor combuston of the logs in the firebox.

Efficient combustion is not only important to economize on fuel, but also to reduce the existence of particulate and other emissions passing up the flue stack, which not only pollute the air but also result in soot and/or creosote buildup in the flue stack. One way to reduce these emissions while obtaining the greatest amount of energy from a given amount of fuel is to use a plurality of combustion chambers. However, the substantial initial expense of multiple-chambered stoves has often not been justified despite a resulting increase in combustion efficiency. U.S. Pat. Nos. 4,201,185 to Black and 4,184,473 to McIntire exemplify recent efforts with stoves having two combustion chambers. These stoves both have the drawback of injecting unheated ambient air into a secondary combustion chamber. This dramatically reduces the efficiency which is otherwise possible when a secondary burn is included.

Hence, it is a primary object of the invention to provide an improved free standing stove which effectively and reliably overcomes the aforementioned limitations and drawbacks of the prior art proposals. More specifically, the present invention has as its objects one or more of the following taken individually or in combination:

(1) The provision of a stove which has improved combustion efficiency, which thereby results in economical use of fuel and relatively complete combustion, thereby reducing stack emissions which cause pollution and are likely to cause dangerous creosote buildup in the stack;

(2) To develop a stove having a primary and secondary combustion chamber, in which the secondary combustion air is substantially heated before injection into the secondary combustion chamber;

(3) To provide a wood stove in which the primary combustion chamber or firebox is adequately insulated to maintain the combustion temperatures therein and to reduce the danger of extremely hot external stove surfaces;

(4) The provision of a free standing stove which is suitable for burning wood and other solid combustibles, such as coal and the like, which may be easily adapted to exhaust into a flue pipe extending either from the top or the back thereof;

(5) The development of a free standing stove having primary and secondary combustion chambers in which combustion air is swirled and otherwise directed to maximize combustion efficiency;

(6) To provide a stove with a secondary combustion chamber in which the secondary combustion air is injected inwardly from the sides thereof so that combustion therein is centered at a point spaced from the combustion chamber walls, to thereby maximize combustion efficiency and prolong the stove life; and (7) The provision of a free standing stove which maximizes combustion efficiency, yet which is relatively simple in construction and therefore inexpensive to purchase and to maintain.

SUMMARY OF THE INVENTION

This invention responds to the problems presented in the prior art by providing a stove including the following features: (1) a firebox for initiating the combustion of fuel, the firebox including a lower portion with a draft inlet therein; (2) a first conduit disposed under the firebox for conveying combustion air to a draft inlet and for insulating the underside of the firebox; (3) a secondary combustion chamber for receiving hot gases of combustion from the firebox and continuing the combustion; (4) a second conduit which receives air from the first conduit adjacent the draft inlet and which conveys all the air which has not passed through the draft inlet along the periphery of the firebox and into the secondary combustion chamber, thereby increasing the flow of air through the secondary combustion chamber during periods of low combustion and for continuing the insulation of the firebox; and (5) a third conduit for conveying the gases of combustion from the secondary combustion chamber to a flue.

The second conduit normally has at least one upwardly extending portion which is narrow and long in cross section and which has one long wall defined by an exterior wall of a firebox, thereby cooling the firebox wall and substantially preheating the secondary combustion air. In one preferred embodiment, four such narrow, long, upwardly extending second conduit portions are provided, which combine to surround four sides of the firebox, thus insulating the firebox to permit higher firebox temperatures.

Another embodiment of the invention includes baffle means disposed adjacent the upper end of the second conduit which directs the secondary combustion air inwardly away from the outer wall or walls of the stove, thereby causing substantial agitation between the secondary combustion air and the gases of combustion rising from the firebox and tending to reduce the temperature of the secondary combustion chamber walls to prolong the life thereof.

In yet another embodiment of the invention, the draft inlet includes obliquely disposed vane means for directing combustion air into the firebox at one or more oblique angles.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a perspective view of a third embodiment of the present invention;

FIG. 9 is a side elevation sectional view taken along line 9—9 of FIG. 8;

FIG. 10 is a perspective view of a vaned draft inlet typically used with the third embodiment.

DETAILED DESCRIPTION OF THE PREFERRED EMBODIMENTS

The Embodiment of FIGS. 1-6

Figure 1:
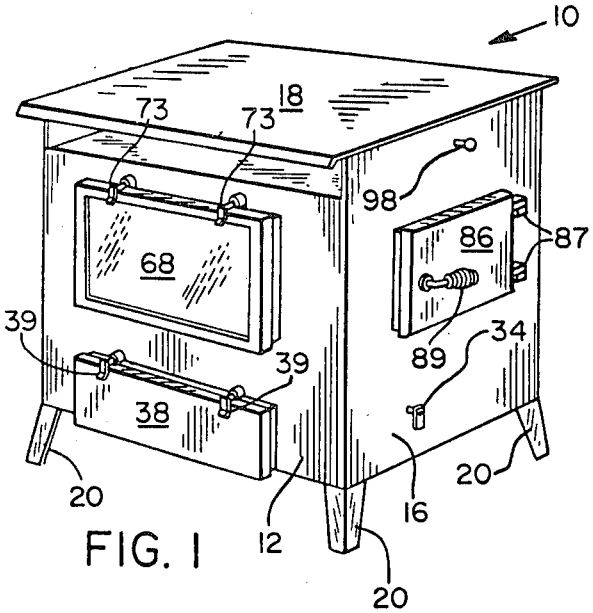
FIG. 1 is a perspective view showing the front of the stove which comprises one embodiment of the present invention.

The principles of this invention are particularly useful when embodied in a free standing stove such as that illustrated in FIGS. 1-6, generally indicated by the numeral 10. The exterior surfaces of stove 10 include a front plate 12, a back plate 14, a pair of s/16 inch steel plate. The heavier plate is desirable for top plate 18 because of the higher temperatures typically encountered and the fact that top plate 18 may have to support heavy pots and pans when the stove is used for cooking. Stove 10 is supported by four angle iron legs 20, one of which is mounted to each corner.

Figure 3:
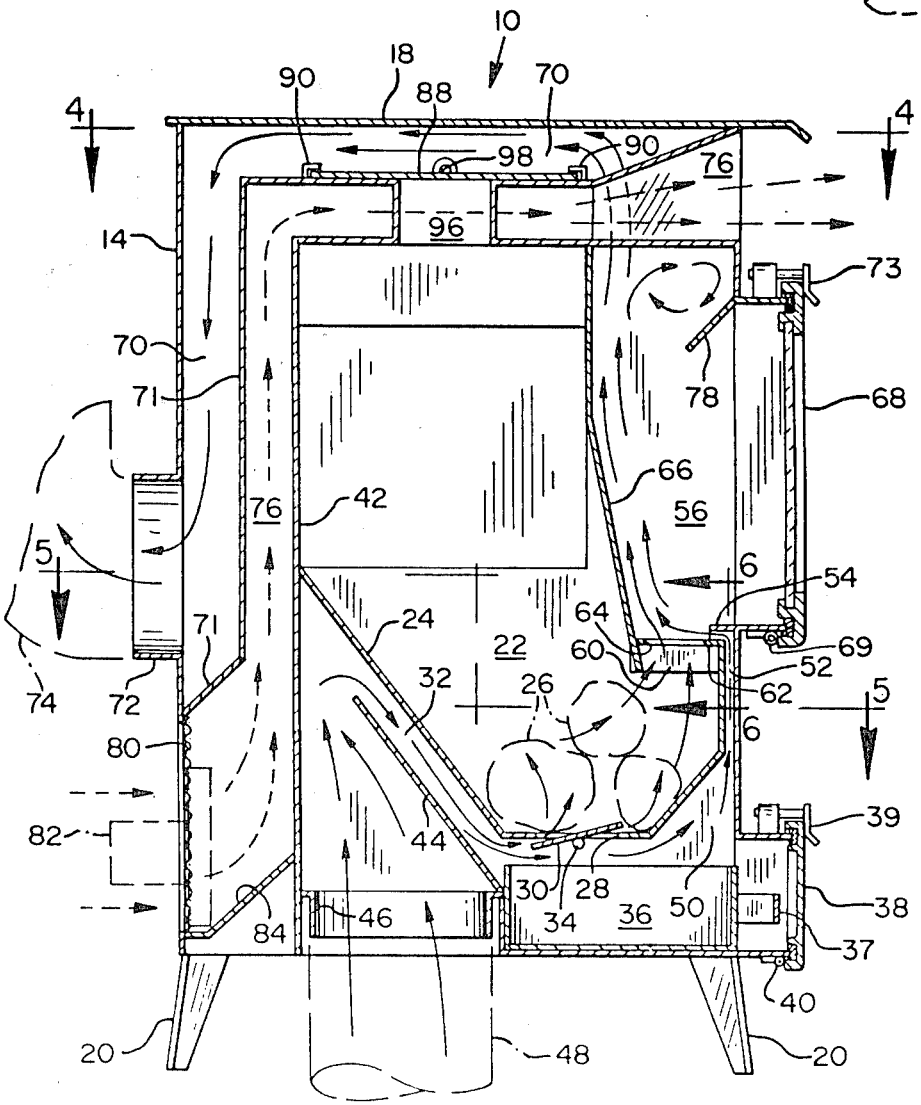
FIG. 3 is a sectional side elevation view of the embodiment of FIG. 1.

As shown best in FIG. 3, stove 10 includes a centrally disposed firebox 22. The firebox is defined between side plates 16 by a hearth plate 24. This hearth plate 24, typically formed from ¼ inch thick steel plate, is of such a configuration that the fuel, typically wood logs shown at 26, is concentrated in the front of firebox 22 immediately above a draft inlet slot 28 and a draft inlet damper 30. This configuration of hearth plate 24 permits the loading of moist or freshly cut logs (not shown) into firebox 22 above the logs 26 which are positioned in the lower forward portion of the firebox and which are actually burning. These moist logs will thus be dried by the heat from the burning logs 26.

Figure 5:
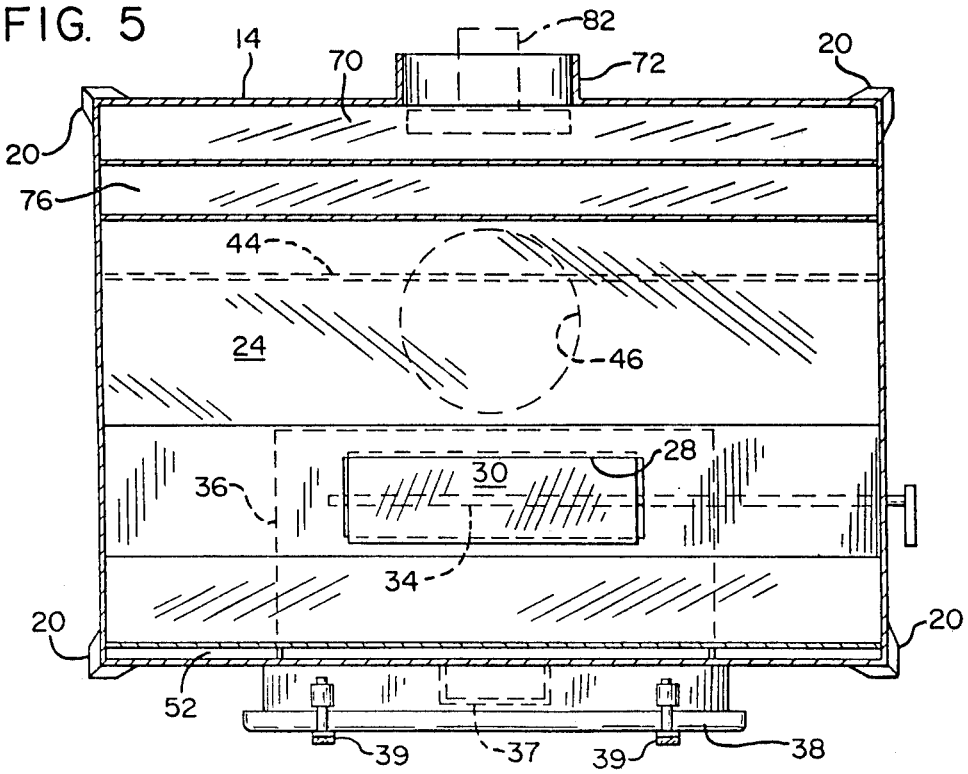
FIG. 5 is a sectional plan view taken along line 5—5 of FIG. 3.

In the event that coal is going to be primarily used as a fuel, it may be desirable to position a grate (not shown) across the bottom of the firebox Draft inlet damper 30, also shown in FIG. 5, controls the flow of draft air from a first conduit 32 through draft inlet slot 28 and into firebox 22. Draft inlet damper 30 may optionally include one or more apertures so that even when it is fully closed, a certain amount of draft inlet air will be permitted to flow into firebox 22. This is not a preferred feature, however, so it is not depicted in the figures. It may also be desirable in certain applications to include a plurality of aligned draft inlet dampers. Normally, however, one is sufficient, so only one damper is included in the depicted embodiments.

Draft inlet damper 30 is mounted to a control shaft 34 which extends out the side of the stove to permit the operator to vary the position of the draft inlet damper, and thereby control the rate of introduction of draft air into firebox 22. A locking wing nut (not shown) or other means may optionally be included to permit the control shaft and the draft inlet damper to be locked in position.

The position of draft inlet slot 28 is such that ash and other by-products of combustion will tend to drop downwardly into an ash receptacle 36 positioned immediately below the draft inlet slot 28 when the draft inlet damper 30 is open. This ash receptacle 36 includes a handle 37 and is generally in the shape of a drawer which may be removed through an access door 38 in the front of stove 10. This access door 38 is hinged along its lower edge at 40 and, when closed through the use of closure dogs 39, fits snugly to prevent the leakage of ash and/or heat therethrough.

First conduit 32 takes draft air from the underside of the stove and, as shown by the solid arrows in FIG. 3, passes the draft air upwardly past a separator plate 42 which extends upwardly from the bottom of the stove, and around a first baffle plate 44 before directing it downwardly along the outer surface of hearth plate 24 and through draft inlet slot 28 into firebox 22. The purpose of first baffle plate 44 is twofold. First, in passing the draft air along the outer surface of hearth plate 24, the draft air is preheated, thus increasing the efficiency of the combustion. Second, first baffle plate 44 prevents the possibility of hot debris dropping from firebox 22 out the bottom of the stove.

It may be desirable in some applications to position the draft inlet damper across the first conduit (not shown), rather than at the bottom of the firebox. Alternatively, an additional damper might be positioned across the first conduit (not shown). In either case, the operator would be able to control the flow of draft air both into the firebox and past it for reasons to be explained below.

First conduit 32 includes a duct adapter 46 at its lower end designed to receive a draft air duct 48 which preferably would be mounted to stove 10. Draft air duct 48 is not necessary if ambient room air, rather than outside air, is to be introduced as draft air into the stove As shown in FIG. 3, some of the draft air passing through first conduit 32 bypasses draft inlet slot 28 to firebox 22. This is particularly true when draft inlet damper 30 is only slightly open. One advantage of the flow of draft air through first conduit 32 and beyond is that a continuous blanket of moving air is provided to insulate the underside of the firebox. This permits stove 10 to be positioned directly over carpet or other floor coverings which might have a tendency to burn or scorch in the presence of conventional stoves.

The draft air which has bypassed firebox 22 is directed via a second conduit 50 upward through a narrowed section 52 and past a second baffle plate 54 into a secondary combustion chamber 56. The constriction in narrowed section 52 of second conduit 50 results in an increase in velocity in the draft air which, in combination with the disruption in flow caused by second baffle plate 54, causes a significant amount of turbulence as the draft air mixes with hot gases of combustion passing upwardly into secondary combustion chamber 56 from firebox 22. It may be desirable under certain conditions that the position of the second baffle plate be adjustable in order to vary the velocity, angle and/or rate of introduction of draft air into the secondary combustion chamber. Such adjustability could be provided by the addition of a hinge (not shown) or other conventional movable mounting means.

Figure 6:
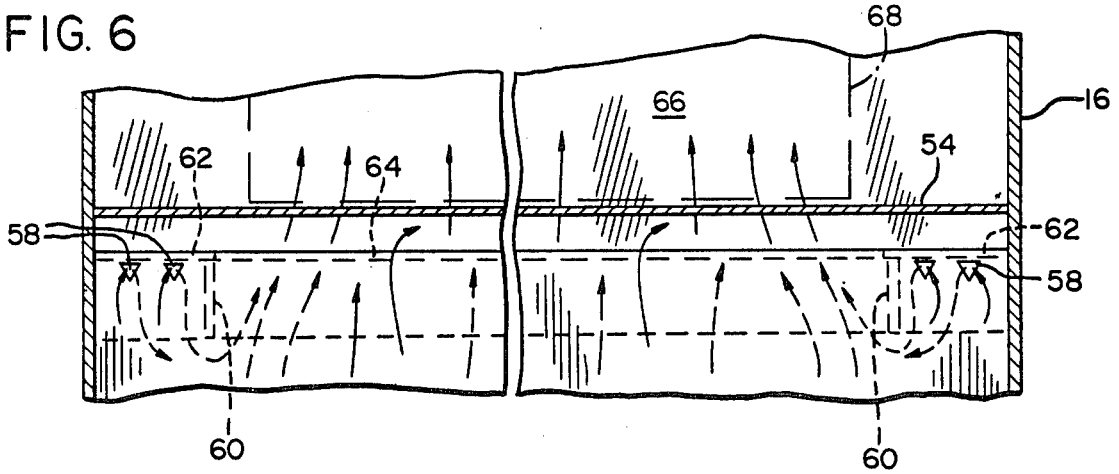
FIG. 6 is a fragmentary sectional front elevation view taken along line 6—6 of FIG. 3.

As shown in FIG. 6, a plurality of aligned apertures 58 are located in the uppermost, front edge of hearth plate 24 so that a certain amount of draft air is permitted to mix with the gases of combustion before they actually enter secondary combustion chamber 56. FIG. 6 also shows two side baffles 60 which are mounted to the underside of a secondary combustion chamber bottom plate 62. This bottom plate 62 extends inwardly from each side plate 16 to side baffles 60, but between the side baffles merely serves to define a combustion gas inlet 64 to the secondary combustion chamber. Side baffles 60 cooperate with bottom plate 62 to force the combustion gases and the draft air passing through apertures 58 toward the center of the stove 10. This is desirable for reasons to be described below.

As shown in FIG. 3, the draft air rising up through second conduit 50 directs the hot combustion gases against a rear wall 66 of secondary combustion chamber 56. This is desirable to minimize the transmission of heat to a tempered glass inspection door 68. This inspection door 68 is desirable to permit the flames within the secondary combustion chamber 56 to be visible from outside the stove. Inspection door 68 is typically mounted by a hinge 69 to permit it to be opened for cleaning. It can be locked in the closed position through the use of pivotable closure dogs 73.

The combustion gases rising out of secondary combustion chamber 56 pass into a third conduit 70 which is initially defined between rear wall 66 and front plate 12. The third conduit follows the outer surfaces of the stove past top plate 18 and back plate 14, where it is defined between the back plate and a third conduit plate 71. The gases then are directed into a flue 72 and up out of the stove through a flue stack 74. In some applications it may be desirable to mount the flue stack at the top of the stove. This is not a preferred embodiment, however, and is therefore not depicted.

Figure 4:
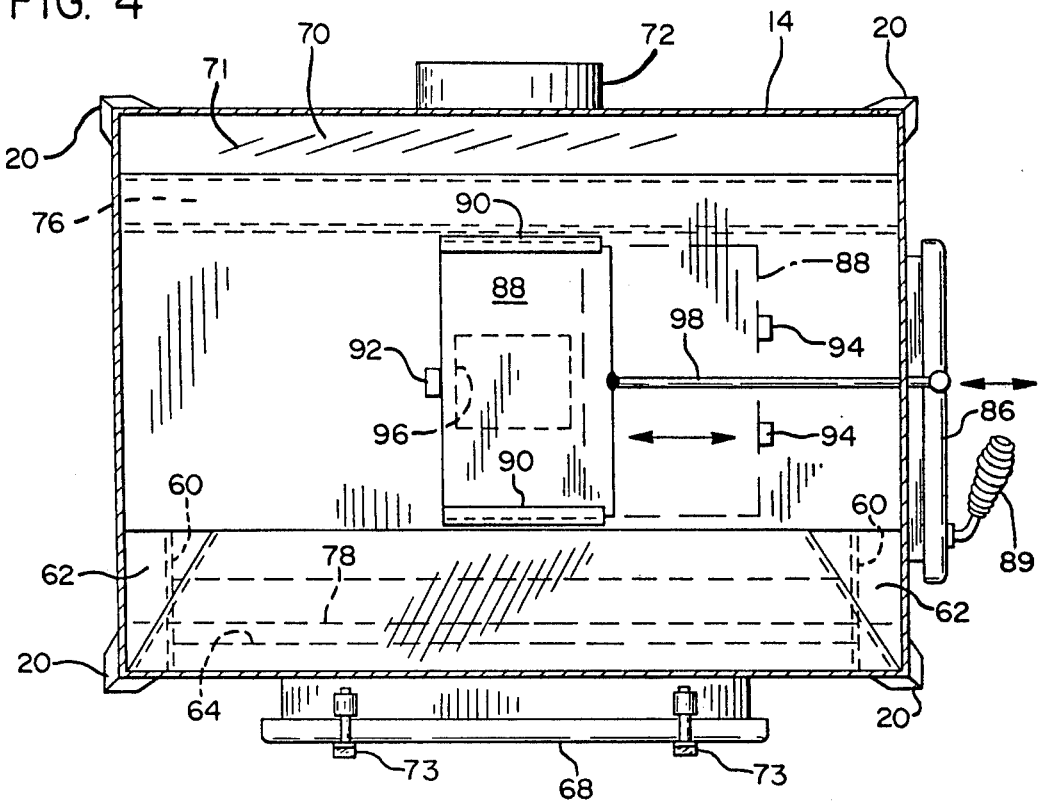
FIG. 4 is a sectional plan view taken along line 4—4 of FIG. 3.

Immediately after third conduit 70 receives the combustion gases from secondary combustion chamber 56, the flow of gases is disrupted by a fourth conduit 76 which extends across and through third conduit 70. As will be described more fully below, fourth conduit 76 conveys ambient air through the stove 10 prior to discharging it out the front of the stove. As the rising combustion gases contact the underside of fourth conduit 76, they are disrupted, causing a slight swirling as shown in FIG. 4. A shield plate 78 extends diagonally inwardly from front plate 12 in order to prevent the swirling gases from contacting inspection door 68.

As mentioned above, the embodiment of FIGS. 1–6 includes a fourth conduit 76. This fourth conduit 76 takes ambient air in through a screen 80 in the back of the stove. The passage of the ambient air through fourth conduit 76 is illustrated in FIG. 3 by broken lines and arrows, thereby distinguishing the air from the combustion gases and draft air shown in solid lines. A fan 82 is included in the depicted embodiment to accelerate the flow of air into and through fourth conduit 76. While fan 82 increases the heat output of the stove, it is not absolutely necessary since the heated air will automatically rise through fourth conduit 76 by natural convection. In the event fan 82 is included, an air direction plate 84 is positioned immediately in front of the fan to redirect the ambient air from a horizontal to a vertical direction.

As illustrated, fourth conduit 76 extends upwardly across the top end of firebox 22 and then through third conduit 70, before discharging the now-warmed ambient air out of the stove. As shown in FIGS. 3 and 4, fourth conduit 76 diverges outwardly and upwardly as it passes through third conduit 70. This configuration permits the natural expansion of the air as it is heated by the hot combustion gases. Since fourth conduit 76 is centered within third conduit 70, and the combustion gases tend to be centered by bottom plate 62 and side baffles 60, this configuration maximizes the disruption of the flow of the combustion gases, thereby increasing the transmission of heat to the ambient air.

Figure 2:
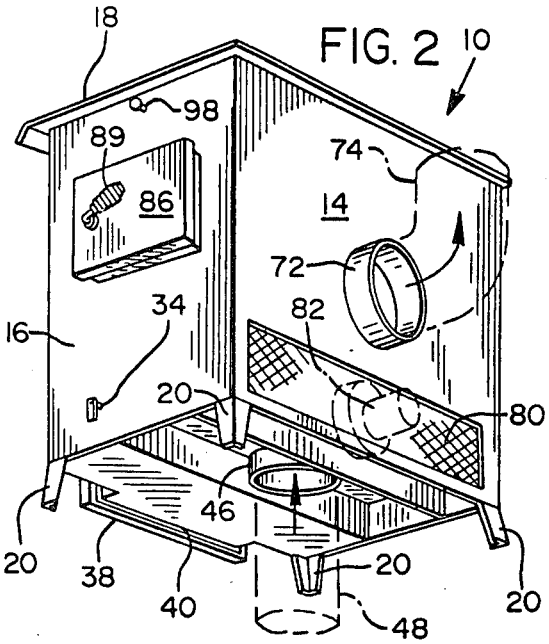
FIG. 2 is a perspective view of the embodiment of FIG. 1, showing the underside and rear of the stove.

As shown in FIGS. 1 and 2, a firebox access door 86 is included which is mounted to one of side plates 16 by hinges 87. Through this door the operator can achieve access to firebox 22 for adding fuel, cleaning, etc. Firebox access door 86 can be closed and locked by rotating a handle 89 which is mounted to a conventional, concealed lever (not shown).

A slidably mounted bypass plate 88 is mounted between a pair of a aligned angle iron runners 90 in the upper part of the stove 10. Closing and opening stops 92 and 94, respectively, are provided to prevent dislodgement of bypass plate 88 from the runners 90. A control rod 98 extends out the side of the stove 10 to permit the operator to control the position of bypass plate 88. Bypass plate 88 is mounted immediately above a bypass conduit 96, which is shown in cross section in FIG. 4 and in elevation in FIG. 3. When bypass conduit 96 is opened, combustion gases are permitted to flow up toward the top of firebox 22, through bypass conduit 96 and into third conduit 70, thus bypassing secondary combustion chamber 56. It is desirable to open bypass conduit 96 when the stove is being lit and at any other time firebox access door 86 is open. This ensures that the combustion gases pass into third conduit 70 and out flue 72 rather than out firebox access door 86. For this reason, it may be desirable in certain applications to link bypass plate 88 and firebox access door 86, to automatically retract the former when the latter is opened. This linkage would be of conventional design and therefore is not depicted.

Operation of the Embodiment of FIGS. 1-6

Prior to lighting stove 10, it should be determined whether an adequate supply of logs, coal or other fuel is in firebox 22. This can be ascertained through firebox access door 86, through which additional fuel can be added if needed. The operator should also determine, through ash receptacle access door 38, whether ash receptacle 36 needs to be emptied. Prior to lighting stove 10, bypass plate 88 should be pulled outwardly until it contacts opening stops 94, thus opening the bypass conduit 96. Draft inlet damper 30 is then opened by turning control shaft 34, thus permitting draft air to flow into firebox 22.

The logs 26 or other fuel may then be lit through firebox access door 86. Any combustion gases generated during the lighting process will pass through bypass conduit 96 into third conduit 70, and out the flue 72, due to the inherent induction of the gases up flue stack 74. Once the fire has started and firebox access door 86 is closed, bypass conduit 96 may be closed by pushing in control rod 98.

When bypass conduit 96 is closed, the combustion gases will pass from firebox 22 up into secondary combustion chamber 56, where they are thoroughly mixed with draft air which has bypassed draft inlet slot 28 and passed through second conduit 50 and its narrowed section 52, thus increasing its velocity before being directed at a right angle by second baffle plate 54 into the stream of combustion gases. A portion of the draft air passes through apertures 58 in the upper edge of hearth plate 24, thus directly mixing with the combustion gases before they enter secondary combustion chamber 56. This draft air and the combustion gas is directed inwardly by side baffles 60 and bottom plate 62.

The turbulence resulting from the introduction of the accelerated stream of draft air into the stream of hot combustion gases passing into secondary combustion chamber 56 results in a thorough mixing of the two streams. This causes combustion of the preheated, gasified fuel to continue, thus greatly adding to the completeness and thus the efficiency of the combustion. This not only results in an increase in the amount of heat released by the stove per unit of fuel, but also burns most of the emissions which would otherwise be discharged up flue stack 74.

The combustion gases passing from secondary combustion chamber 56 into third conduit 70 are directed against fourth conduit 76 extending across in the path of the combusion gases. Only a small proportion of the gases pass directly by fourth conduit 76, but even those gases impart heat to the side walls of the fourth conduit. This is because the combustion gases were directed laterally inward by side baffles 60 and bottom palte 62. Eventually, all of the combustion gases pass around fourth conduit 76, and across the top of the stove 10 immediately below top plate 18. This heats top plate 18, radiating heat into the ambient air and providing a hot surface for cooking. At the same time, the combustion gases are providing heat to the air in fourth conduit 76. This continues as the combustion gases are directed downwardly to flue 72.

If a substantial amount of heat is required from stove 10, fan 82 may be energized. Alternatively, a thermostat (not shown) may be used to regulate energization of fan 82. However, even without fan 82, ambient air will enter the lower end of fourth conduit 76 and pass upwardly between third conduit 70 and separator plate 42, thus being heated from both sides. This continues until fourth conduit 76 extends across third conduit 70, where the hottest combustion gases come into contact with it.

The present invention is thus a dramatic improvement over prior art designs since most of the heat is imparted to the ambient air when it is at its highest temperature, i.e., immediately before it leaves the stove 10. The cooler combustion gases which are about to pass out the flue 72 initiate the heating process. Thus, at all times, the temperature difference between the combustion gases and the ambient air is kept at a minimum.

Figure 7:
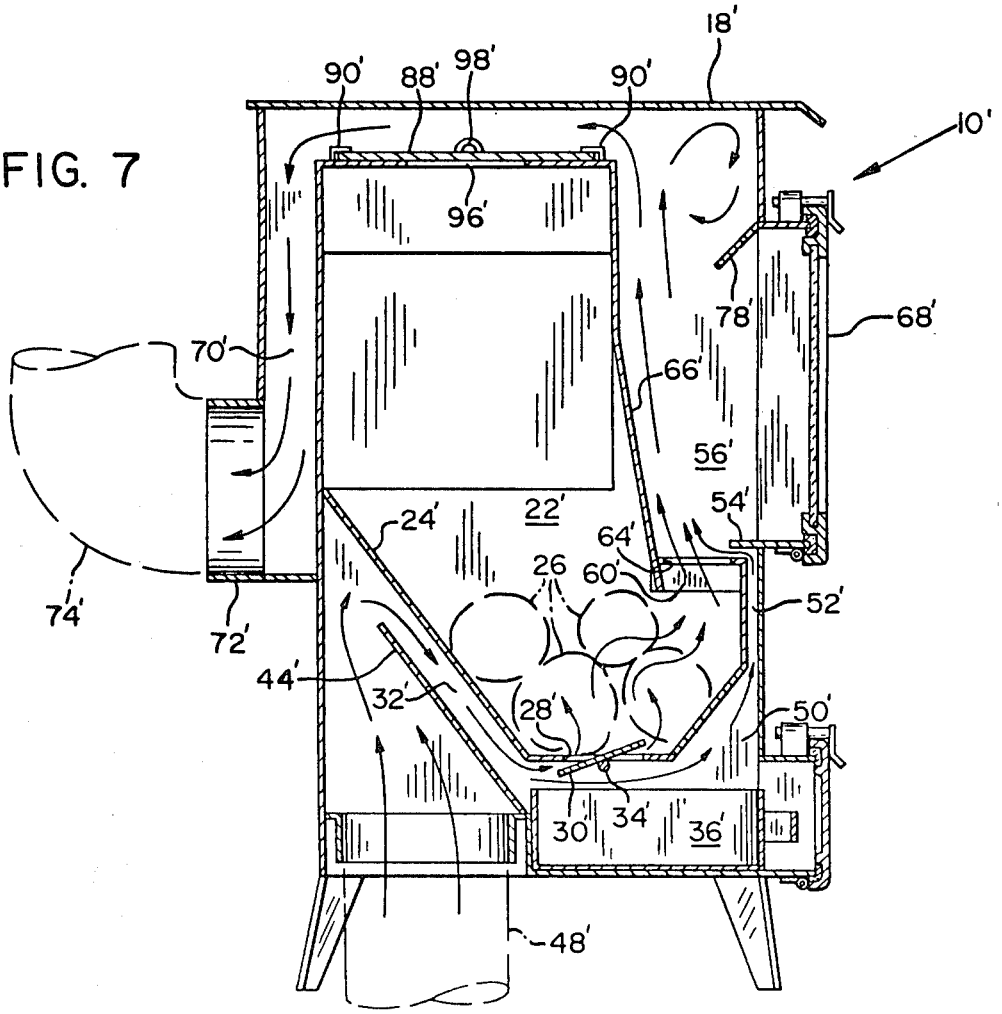
FIG. 7 is a sectional side elevation view of a second embodiment of the present invention.

The Embodiment of FIG. 7

A second embodiment of the present invention is depicted in FIG. 7 and is identified with the numeral 110. The basic difference between this stove 110 and stove 10 is that a fourth conduit, which circulates ambient air through stove 10, is not included. Thus, stove 110 relies solely upon radiation of heat into the ambient air rather than the combination of such radiation with natural convection. Stove 110 includes all of the elements of the previously described stove 10, and these elements have been identified in FIG. 7 with corresponding numerals except that they are in the 100 series.

In this embodiment, the draft air passes via draft air duct 148 and first conduit 132, either through draft inlet damper 130 and draft inlet slot 128 into firebox 122, or past the draft inlet slot and into secondary combustion chamber 156. Second baffle plate 154 directs this draft air at right angles against hot combustion gases rising through combustion gas inlet 164. The turbulent combustion gases and draft air are thus directed against rear wall 166, where the combustion continues. The resulting combustion gases rise past inspection door 168 and shield plate 178 and into third conduit 170. As the combustion gases pass through third conduit 170, they impart heat to top plate 118, which radiates heat into the room. The combustion gases then pass out flue 172 and flue stack 174.

When stove 110 is being lit and at any other time the firebox access door is open, bypass plate 188 is retracted. This is done in the same way as with the first embodiment 10; that is, control rod 198 is pulled, which causes bypass plate 188 to slide outwardly along angle iron runners 190. This permits combustion gases to flow upwardly from firebox 122, directly into third conduit 170, thus bypassing secondary combustion chamber 156. When the firebox access door is closed, bypass plate 188 is pushed back to its original position, thus sending the combustion gases from firebox 122 into secondary combustion chamber 156.

The Embodiment of FIGS. 8–11

A third embodiment of the present invention is depicted in FIGS. 8–11 and has been generally indicated with the numeral 210. To simplify this description, components which are similarly disposed or which operate in similar fashion to components of the first and second embodiments 10 and 110 have been designated with common numerals except that the 200 series has been used for this third embodiment. Components of this third embodiment which have no counterparts in the first and second embodiments have been designated with different numerals of the 200 series.

Stove 210 includes a front plate 212, a back plate 214, a pair of side plates 216, and a top plate 218. These are typically welded together to form a virtually airtight unit. As seen best in FIG. 11, side panels 219 are mounted externally of side plates 216 to define a pair of upwardly extending side air channels 221 which permit ambient air to be naturally drawn into the lower portion thereof, to pass along the outer sides of side plates 216 and to collect heat therefrom, before being discharged out of the upper ends. Similarly, a back panel 223 is mounted outwardly of back plate 214 to define a back air channel 225. The upper periphery of back panel 223 has a forwardly bent lip 217 which directs the air rising out the top to back air channel 225 to be directed forwardly, into the room. A blower is typically included at the lower end of back panel 223 to force air through back air channel 225 but is an optional feature and has not been depicted for purposes of simplification. This air circulation through side air channels 221 and back air channel 225 not only causes the ambient air to be heated but also tends to cool back plate 214 and side plates 216, prolonging the life thereof.

Stove 210 is supported by a centrally disposed pedestal or base 220 which elevates the stove above the floor to minimize the heat conducted to the floor and to facilitate introduction of combustion air into the stove, as will be explained below.

Stove 210 includes a centrally disposed firebox 222. The bottom of firebox 222 is defined by a horizontally disposed hearth plate 224 which is of substantial thickness, typically ¼ inch plate, to prolong its life and to facilitate the support of a substantial fuel load.

Figure 11:
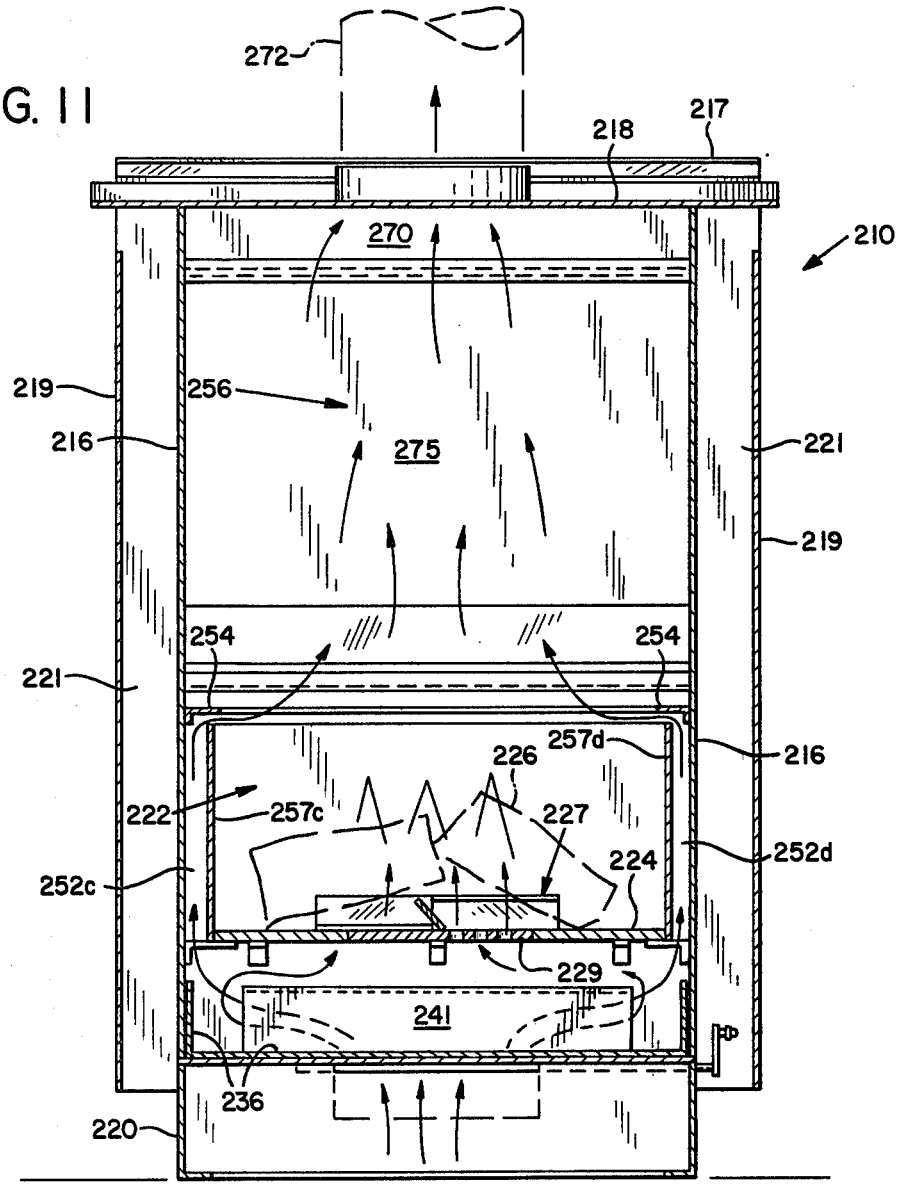
FIG. 11 is a front elevation sectional view taken along line 11—11 of FIG. 9.

A vaned draft inlet 227 is centrally disposed in hearth plate 224 and includes a draft inlet plate 229 with a plurality of draft inlet openings 228*a* and 228*b* therein. The draft inlet openings 228*a* and *b* are typically of two sizes, with the smaller openings 228*a* being aligned in close proximity to four radially extending, oblique vanes 230*a*, 230*b*, 230*c*, and 230*d* which cause the combustion air passing through draft inlet plate 229 to be swirled as it enters firebox 222. As seen in FIGS. 9 and 11, vanes 230*a–d* also serve to cant logs 226 at various angles to facilitate the flow of combustion air around and between the logs. The stove 210 may alternatively be provided with a draft inlet damper, such as that depicted in the first embodiment 10, in place of vaned draft inlet 227. However, since this is not the preferred construction, it has not been depicted.

As shown in FIGS. 9 and 11, combustion air flows into base 220, past a combustion air damper 231, around an ash deflector plate 241, and into a first conduit 232. Combustion air damper 231 is pivotally mounted to back plate 214 and is controlled by a combustion air control rod 233, permiting the operator to vary the rate of introduction of combustion air into the firebox. A locking wing nut (not shown) or other means may be included to permit combustion air control rod 233 and combustion air damper 231 to be locked into position. As seen in FIG. 11, ash deflector plate 241 does not extend all the way from side to side of stove 210; so combustion air is able to flow around the ends of the deflector plate, over an ash receptacle 236, through first conduit 232 and draft inlet openings 228*a* and *b*, and into firebox 222. Ash deflector plate 241 prevents ash from dropping past combustion air damper 231 into base 220.

The design of base 220 is such that it can be adapted to receive combustion air either from an external source outside of the building, via a conduit (not shown) which extends upwardly through the floor, or can be adapted to receive ambient air through a frontal combustion air intake 235. Frontal combustion air intake 235 is depicted as being sealed in FIG. 9, because combustion air is shown entering from outside of the building through the bottom of base 220. In the event stove 210 is disposed on a flat, closed floor, frontal combustion air intake 235 is opened to draw ambient air into base 220. It can be seen that frontal combustion air intake 235 is at the extreme bottom of stove 210 to draw the coolest ambient air into the base, thereby promoting rapid heating of the room.

The position of draft inlet openings 228*a* and *b* is such that ash and other by-products of combustion drops downwardly into ash receptacle 236 positioned immediately therebelow. Ash receptacle 236 is linked to an access door 238 in the front of stove 210, so that when the access door is opened, the ash receptacle slides out. This access door is provided with a closure dog 239 which permits the access door to be tightly fastened to the stove to prevent leakage of ash and/or heat therethrough. As seen in FIG. 9, the end of ash receptacle 236 is inclined and open so that it acts like a scoop in the event any ash or other debris has dropped through draft inlet openings 228*a* and *b* when the ash receptacle is being emptied.

As shown in FIGS. 9 and 11, some of the combustion air which passes through first conduit 232 bypasses draft inlet openings 228*a* and *b* into firebox 222, thereby providing a continuous blanket of moving air to insulate the underside of hearth plate 224. The draft air which has bypassed firebox 222 is directed via a second conduit past a baffle plate 254 into a secondary combustion chamber 256.

The second conduit consists of four portions 252*a*, 252*b*, 252*c*, and 252*d* which are narrow and long in cross section and which cooperate to surround all four sides of firebox 222. The outer periphery of second conduit portions 252*a–d* is thus defined by front plate 212, back plate 214, and side plates 216, with the inner periphery being defined by four firebox walls 257*a*, 257*b*, 257*c*, and 257*d*. The configuration of first conduit 232 and second conduit portions 252*a–d* is such that the bottom and sides of firebox 222 are totally surrounded by blankets of moving air, thereby insulating the firebox to permit higher firebox temperatures while providing a certain amount of cooling to hearth plate 224 and firebox walls 257*a–d* to prolong the life thereof. At the same time, this design serves to preheat both the primary and secondary combustion air.

A baffle plate 254 causes the secondary combustion air to be injected into a secondary combustion chamber 256 in a substantially horizontal, inward direction. Baffle plate 254 typically is removable and replaceable to permit cleaning or replacement, either by an identical plate or one which narrows or widens the opening through which the secondary combustion air is injected, or which varies the angle of injection. Baffle plate 254 is typically supported above firebox 222 by a plurality of spaced tabs 259.

The injection of secondary combustion air is at approximately right angles to the hot gases of combustion passing upwardly into the secondary combustion chamber from firebox 222. These gases of combustion may still be swirling as a result of vanes 230*a–d*; so the impingement of the secondary combustion air from all four sides causes additional agitation, bringing about extremely efficient combustion within secondary combustion chamber 256. The fact that second conduit portions 252*a–d* are narrow in cross section also results in substantial velocity of secondary combustion air, which further increases agitation as the combustion air is injected into secondary combustion chamber 256. Moreover, because the secondary combustion air is injected inwardly, the walls of secondary combustion chamber 256 tend to be cooler than they otherwise might be, thereby prolonging the life thereof. A gasket 277 seals inspection door 268 with respect to stove 210 except along the upper portion thereof which permits a limited amount of air leakage into the stove. As shown schematically with flow arrows in FIG. 9, this air flows downwardly over inspection door 268 to reduce the accumulation of smoky film on the glass of the door.

The inward direction of the secondary combustion air minimizes the transmission of heat to a tempered glass inspection door 268 which is provided to permit the flames within secondary combustion chamber 256 to be visible from outside the stove. Inspection door 268 is typically mounted by a hinge 269 which permits the door to be opened for loading logs 226 and other fuel into the stove. Inspection door 268 can be locked in a closed position with a pivotal closure dog 273.

A back baffle 275 is provided in the upper and back portions of secondary combustion chamber 256 to disrupt and slow the flow of combustion gases rising out of the secondary combustion chamber into a third conduit 270 and to a flue 272. The same is true if the flue is mounted to the back of the stove as schematically depicted in phantom at 273. Back baffle 275 is typically merely placed in position as depicted and is not welded or otherwise permanently affixed, thereby facilitating its replacement which may be periodically necessary due to the high temperatures encountered in the secondary combustion chamber. There are several basic purposes for back baffle 275. First, by slowing the flow of combustion gases out of secondary combustion chamber 256, it maintains combustion for a longer period, thereby getting as much possible energy out of the fuel and minimizing stack emissions. Also, as long as the burning gases remain in the stove, they will continue to impart heat to the ambient air via front plate 212, top plate 218, side air channels 221, and back air channel 225. Moreover, back baffle 275 tends to protect back plate 214 and top plate 218 from the high secondary combustion chamber temperatures.

A shield plate 278 performs a similar function at the upper, front portion of secondary combustion chamber 256, protecting inspection door 268 and front plate 212 from the direct impingement of the rising gases of combustion from the secondary combustion chamber.

Operation of the Embodiment of FIGS. 8–11

Prior to lighting the stove 210, ash receptacle 236 should first be emptied. Combustion air damper 231 should then be set to the desired opened position such as that depicted in phantom in FIG. 9 through the use of combustion air control rod 233. Once this is done and a sufficient amount of logs 226 or other fuel has been deposited in firebox 222 through inspection door 268, the stove may be lit by reaching through the inspection door.

Combustion air will be drawn into firebox 222 through base 220, first conduit 232, and draft inlet openings 228*a* and *b*. Vanes 230*a–d* cause the combustion air to be swirled to increase the agitation within firebox 222 and thereby improve the burning. The combustion air which bypasses draft inlet openings 228*a* and *b* passes along the underside of hearth plate 224 to insulate the underside of the firebox and is directed upwardly through second conduit portions 252*a–d*, thereby insulating firebox walls 257*a–d* and providing a substantial amount of preheating to the secondary combustion air. When the secondary combustion air impinges upon baffle plate 254, it is directed inwardly from all four sides, against the burning gases of combustion rising out of firebox 222. This injection of fresh, secondary combustion air results in secondary combustion taking place within secondary combustion chamber 256. The inward injection of the secondary combustion air causes the high combustion temperatures to be concentrated in the center of the stove 210 to increase the life of the stove and to maximize the efficiency of combustion. This effect is further accentuated by back baffle 275 and shield plate 278, which prevent the gases of combustion of secondary combustion chamber 256 from coming into immediate contact with front plate 212, back plate 214, top plate 218, and inspection door 268. Thus, combustion is maintained for a longer period within secondary combustion chamber 256, and the external stove components are protected. Eventually, the gases of combustion pass over back baffle 275 and are directed out flue 272.

During both primary and secondary combustion, heat is continuously being conveyed to front plate 212, back plate 214, and side plates 216. Natural convection of ambient air through side air channels 221 and back air channel 225 also causes heat to be conveyed into the ambient air, yet provides a sufficient amount of insulation to maintain the high combustion temperatures within the stove 210.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A stove comprising:

a firebox for initiating the combustion of fuel, said firebox including a fuel supporting lower portion with a draft inlet therein;

a first conduit disposed under said firebox for conveying combustion air to said draft inlet and for insulating the underside of said lower portion;

a second combustion chamber receiving hot gases of combustion from said firebox and continuing the combustion;

a second conduit which receives combustion air from said first conduit adjacent said draft inlet and which conveys the combustion air which has not passed through said draft inlet along the periphery of said firebox and into said secondary combustion chamber, thereby increasing the flow of combustion air through said secondary combustion chamber during periods of low combustion and for continuing the insulation of said firebox, said first and second conduits cooperating to envelop 2. The stove of claim 1 wherein said second conduit includes a narrowed section adjacent said secondary combustion chamber which increases the velocity of combustion air flowing therethrough and baffle means for directing the combustion air into the flow of combustion gases passing from said firebox.

3. The stove of claim 1 wherein said firebox and said secondary combustion chamber are closed to the atmosphere except for said first conduit which introduces combustion air into the stove and said third conduit which conveys gases of combustion from said second combustion chamber.

4. The stove of claim 1 wherein said second conduit comprises at least one upwardly extending portion which is narrow and long in cross section and which has at least one long wall defined by an exterior wall of said firebox.

5. The stove of claim 4 wherein said one long wall is defined by a front wall of said firebox, and baffle means is provided adjacent the upper end of said second conduit portion, for injecting the combustion air passing therethrough substantially horizontally into the flow of combustion gases passing from said firebox.

6. The stove of claim 1 wherein said draft inlet includes obliquely disposed vane means for directing combustion air into said firebox at at least one oblique angle 7. The stove of claim 6 wherein said vane means comprises a plurality of radially extending, obliquely disposed vanes positioned proximate a plurality of draft inlet openings to swirl the combustion air entering said firebox 8. The stove of claim 4 wherein four narrow, long upwardly extending second conduit portions are included which cooperate to surround four sides of said firebox.

9. The stove of claim 8, further comprising a back baffle centrally disposed in the upper portion of said secondary combustion chamber spaced from back and top walls of said secondary combustion chamber, said back baffle having a width which is less than the width of said secondary combustion chamber, said back baffle deflecting the rising gases of combustion from the secondary combustion chamber to protect said back and top walls.

10. A free standing stove comprising:

a firebox for initiating the combustion of fuel, said firebox including a bottom with a draft inlet therein, for admitting combustion air into said firebox and for permitting combustion by-products to drop downwardly therethrough and out of said firebox;

a first conduit juxtaposed beneath said firebox for preheating combustion air, conveying such air to said draft inlet and collecting combustion by-products from said firebox;

an open secondary combustion chamber juxtaposed above said firebox for continuing the combustion, said secondary combustion chamber receiving the gases of combustion from said firebox and further oxidizing the gases, said secondary combustion chamber including a lower portion;

a second conduit in thermal contact with at least a portion of the periphery of said firebox for conveying air into said lower portion of said secondary combustion chamber, said second conduit receiving air from said first conduit; and a third conduit for conveying the gases of combustion from said secondary combustion chamber.

11. A stove comprising:

a firebox for initiating the combustion of fuel, said firebox including a lower portion with draft inlet means therein and being defined by upwardly extending walls;

a first conduit beneath said firebox for conveying combustion air to said draft inlet means;

an open secondary combustion chamber above said firebox for receiving gases of combustion from said firebox and continuing the combustion;

second conduit means surrounding said walls of said firebox for conveying combustion air to said secondary combustion chamber and for preheating the combustion air; and a third conduit for conveying the gases of combustion from said secondary combustion chamber.

12. The stove of claim 11 further comprising baffle means mounted adjacent the upper end of said second conduit means, for injecting the combustion air into said secondary combustion chamber at substantially right angles to the flow of combustion gases passing from said firebox.

* * * * *

UNITED STATES PATENT AND TRADEMARK OFFICE

CERTIFICATE OF CORRECTION

PATENT NO. : 4,483,312

DATED : November 20, 1984

INVENTOR(S) : Donald S. Martenson

It is certified that error appears in the above-identified patent and that said Letters Patent is hereby corrected as shown below:

Column 4, lines 22 and 23, "a pair of s/16 inch steel plate". should read -- a pair of side plates 16 and a top plate 18. These plates are welded together to form an airtight unit. Front, back, and side plates 12, 14 and 16 are typically constructed of 10-gauge steel plate, while top plate 18 is preferably constructed of 3/16 inch steel plate. --.

Column 4, line 44, after "firebox" add --.--.

Column 5, line 32, after "stove" add --.--.

Claim 1, column 13, line 25, after "envelop" add -- the underside and periphery of the firebox in a layer of circulating combustion air so as to insulate the walls and underside of said firebox; and a third conduit for conveying the gases of combustion from said secondary combustion chamber. --.

Signed and Sealed this

*Twenty-first* Day of *May 1985*

[SEAL]

*Attest:*

DONALD J. QUIGG

*Attesting Officer* *Acting Commissioner of Patents and Trademarks*